US007482562B2

(12) United States Patent
Song et al.

(10) Patent No.: US 7,482,562 B2
(45) Date of Patent: Jan. 27, 2009

(54) MICROWAVE RANGE CONFIGURED BOTH TO HEAT FOOD AND TO EXHAUST CONTAMINATED AIR GENERATED BY A COOKING APPLIANCE PROVIDED THEREBENEATH

(75) Inventors: Sung Bae Song, Gyeonggi-do (KR); Sang Bum Sohn, Seoul (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/930,676

(22) Filed: Oct. 31, 2007

(65) Prior Publication Data

US 2008/0156792 A1 Jul. 3, 2008

(30) Foreign Application Priority Data

Jan. 2, 2007 (KR) ..... 10-2007-0000135

(51) Int. Cl.
*H05B 6/80* (2006.01)
*F24C 15/20* (2006.01)

(52) U.S. Cl. ..... 219/757; 219/681; 126/21 A; 126/299 D

(58) Field of Classification Search ..... 219/757, 219/756, 681, 400; 126/21 A, 21 R, 299 R, 126/299 D
See application file for complete search history.

(56) References Cited

U.S. PATENT DOCUMENTS

| | | | | |
|---|---|---|---|---|
| 4,327,274 | A * | 4/1982 | White et al. | 219/757 |
| 6,018,158 | A * | 1/2000 | Kang | 219/757 |
| 6,239,419 | B1 * | 5/2001 | Kim | 219/757 |
| 7,180,041 | B2 | 2/2007 | Song et al. | |
| 2003/0218012 | A1 * | 11/2003 | Kim | 219/757 |
| 2007/0210065 | A1 | 9/2007 | Sohn et al. | |

OTHER PUBLICATIONS

U.S. Appl. No. 11/930,721 to Song et al., which was filed on Oct. 31, 2007.

* cited by examiner

*Primary Examiner*—Philip H Leung
(74) *Attorney, Agent, or Firm*—Greenblum & Bernstein, P.L.C.

(57) ABSTRACT

A microwave range having a hood for removing contaminated air includes a chamber and first and second vent fan assemblies respectively positioned at opposite lateral sides of the chamber. The first and second vent fan assemblies draw contaminated air in through an air inlet located on a bottom surface of the microwave range below the chamber, and exhaust the air drawn in through the air inlet.

19 Claims, 3 Drawing Sheets

MICROWAVE RANGE CONFIGURED BOTH TO HEAT FOOD AND TO EXHAUST CONTAMINATED AIR GENERATED BY A COOKING APPLIANCE PROVIDED THEREBENEATH

CROSS REFERENCE TO RELATED APPLICATION

The present disclosure relates to subject matter contained in priority Korean Patent Application No. 2007-0000135, filed Jan. 2, 2007, which is herein expressly incorporated by reference in its entirety.

BACKGROUND

The present disclosure relates to a microwave range, and more particularly, to a microwave having a hood exhausts contaminated air generated during a cooking operation of a cooking appliance installed below the microwave range.

A related art microwave range is a cooking appliance for heating food using microwaves or heat from a heater. An available microwave range includes a hood that filters contaminated air including an exhaust gas generated during a cooking operation of a cooking appliance installed below the microwave range and exhausts the filtered air to an indoor space or an outdoor space.

However, a related art microwave range having a hood has the following limitations.

A related art microwave range provides only one vent fan assembly for performing a hood function. Accordingly, in the case where a large amount of exhaust gases is generated from a cooking appliance installed below a microwave range having a hood, contaminated air containing the exhaust gases cannot be sufficiently exhausted to an indoor space or an outdoor space.

Also, a vent fan assembly is provided on one side of a chamber in a related art microwave range. Accordingly, a volume of a cooking room for cooking food is reduced by the space occupied by the vent fan assembly.

SUMMARY

Embodiments provide a microwave range having a hood function that is configured to efficiently perform a hood function.

Embodiments also provide a microwave range having a hood function that is configured to minimize relative reduction in a volume of a cooking room.

According to an aspect of the present invention, a microwave range having a hood for removing contaminated air includes a chamber; and first and second vent fan assemblies respectively positioned at opposite lateral sides of the chamber, the first and second vent fan assemblies drawing contaminated air in through an air inlet located on a bottom surface of the microwave range below the chamber, and exhausting the air drawn in through the air inlet.

The contaminated air drawn in through the air inlet may be distributed to and flow through the first and second vent fan assemblies. The microwave range may further include an air introduction guide configured to guide the contaminated air drawn in through the air inlet so that it is distributed to and flows through the first and second vent fan assemblies.

The air inlet may include first and second air inlets, the microwave range further including an air introduction guide configured to guide the contaminated air drawn in through the first and second air inlets so that it is distributed to and flows through first and second vent fan assemblies.

The first and second vent fan assemblies may be respectively positioned on left and right sides of an upper surface of a base plate in which the air inlet is provided. The first and second vent fan assemblies may be respectively installed on fan installation portions formed on left and right sides of an upper surface of a base plate in which the air inlet is provided. The fan installation portions may be formed as downwardly recessed portions of the base plate configured to receive a vent fan assembly.

Each of the first and second vent fan assemblies may include a vent motor and a pair of vent fans respectively located on opposite sides of the vent motor.

According to another aspect of the present invention, a microwave range having a hood for removing contaminated air includes a chamber including an electric component room containing electric components; and first and second fan assemblies that draw contaminated air in through an air inlet located on a bottom surface of the microwave range below the chamber, exhaust the air drawn in through the air inlet, and flow air through the electric component room for cooling the electric components.

Each of the first and second fan assemblies may include a fan motor and a pair of fans respectively located on opposite sides of the fan motor, wherein at least one of the fan assemblies includes a cooling fan for cooling the electric components, and a vent fan for drawing in and exhausting the contaminated air.

The microwave range may further include an air introduction guide configured to guide the contaminated air drawn in through the air inlet such that the contaminated air drawn in through the air inlet flows only to the vent fan.

The microwave range may further include an air introduction guide for cooling that guides air drawn in through an air inlet for cooling formed in a front side of the chamber to flow through an air inlet of the cooling fan; and an exhaust guide for cooling that guides air exhausted by a discharge portion of the cooling fan to the electric component room. The air introduction guide for cooling may separate the electric component room into at least two spaces containing the electric components.

According to another aspect of the present invention, a microwave range having a hood for removing contaminated air includes an air introduction passage for venting, through which contaminated air drawn in by a vent fan flows, the vent fan being part of at least one of a pair of fan assemblies; an exhaust passage for venting, through which contaminated air is exhausted to an outside by the vent fan; an air introduction passage for cooling, through which air drawn in by a cooling fan flows to cool electric components contained in an electric component room by driving of a cooling fan, the cooling fan being part of at least one of the pair of fan assemblies; and an exhaust passage for cooling, through which air that has cooled the electric components is exhausted to an outside by the cooling fan.

The air introduction passage for venting may beprovided between a chamber and a base plate located below the chamber, and contaminated air drawn in through an air inlet for venting formed in the base plate flows through the air introduction passage for venting, and is introduced to an air inlet of the vent fan, the vent fan being installed in one of two fan installation portions provided on left and right sides of an upper surface of the base plate.

The exhaust passage for venting may include a first exhaust passage for venting provided on both sides of a chamber; and a second exhaust passage for venting provided on an upper surface of the chamber, and having lateral ends that communicate with upper ends of the first exhaust passage for venting, wherein contaminated air exhausted by a discharge portion of the vent fan installed in one of two fan installation portions provided on left and right sides of an upper surface of a base plate located below the chamber flows through the first and second exhaust passages for venting and is exhausted through one of an indoor air outlet formed in a front side of the chamber, and an outdoor air outlet formed in an upper side of an outer case of the chamber.

The electric component room may be separated into two spaces which are respectively located on the air introduction passage for cooling and the exhaust passage for cooling, and the electric components are contained in both spaces of the electric component room. The air introduction passage for cooling and the exhaust passage for cooling may be separated from each other by an air guide for cooling, and air drawn in through an air inlet for cooling formed in a front side of a chamber flows through the air introduction passage for cooling, enters an air inlet of the cooling fan, and is exhausted by a discharge portion of the cooling fan to flow through the exhaust passage for cooling.

The electric component room may be separated into two spaces by an air guide for cooling that serves as a partition between the air introduction passage for cooling and the exhaust passage for cooling, and the electric components are installed in each of the two spaces of the electric component room.

The exhaust passage for cooling may include a first exhaust passage for cooling, through which air exhausted by a discharge portion of the cooling fan and delivered to the electric component room flows; and a second exhaust passage for cooling, through which air is exhausted to an outside through an air outlet for cooling formed in a front side of a chamber, after the air has cooled the electric components in the electric component room, and has been circulated through a cooking room provided inside the chamber.

According to the present disclosure, a hood function can be more effectively performed, while reduction in the volume of a cooking room is minimized.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the preferred embodiments of the present invention, examples of which are illustrated in the accompanying drawings.

Figure 1:
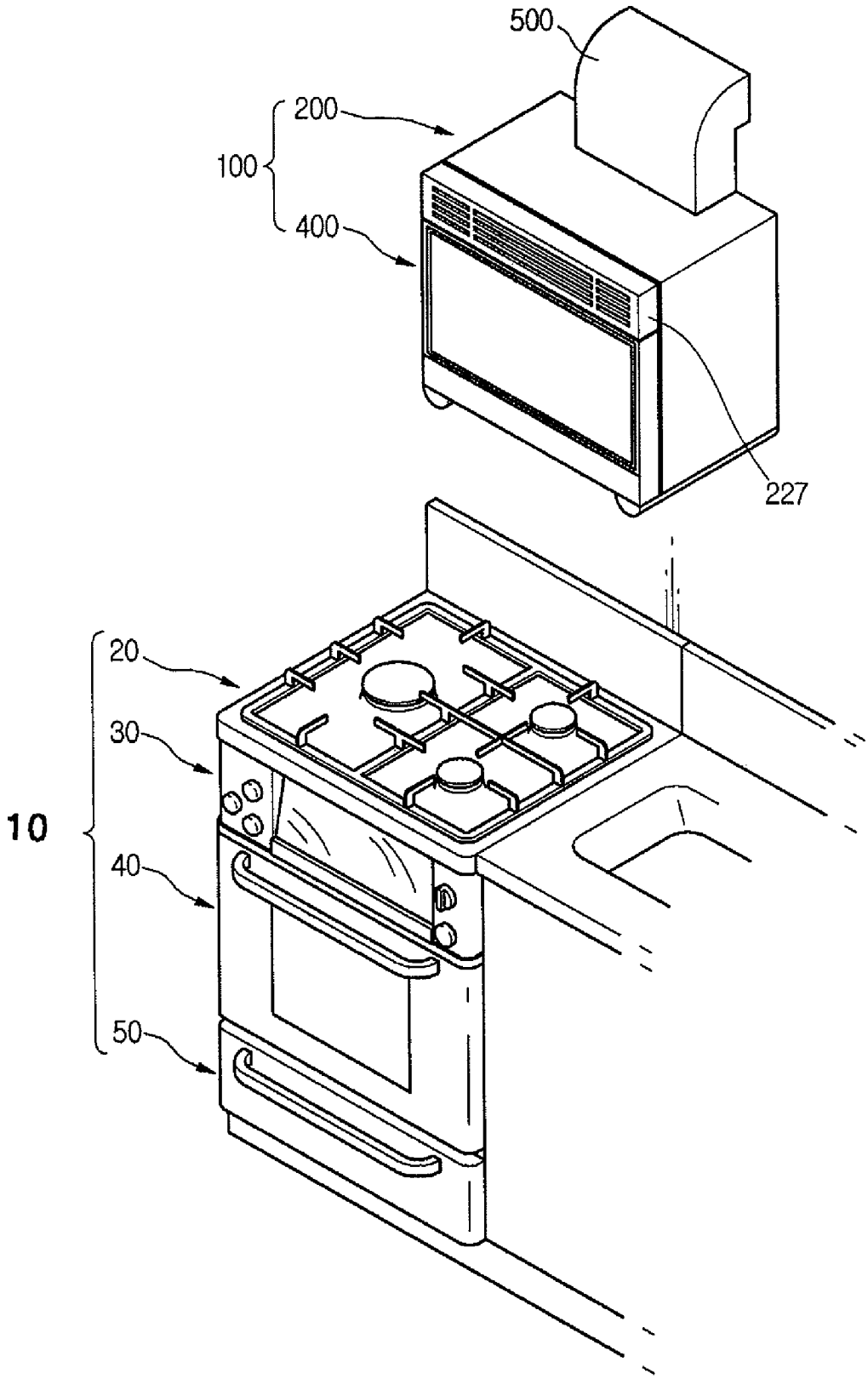
FIG. 1 is a perspective view of a microwave range having a hood according to an embodiment of the present invention.
Figure 2:
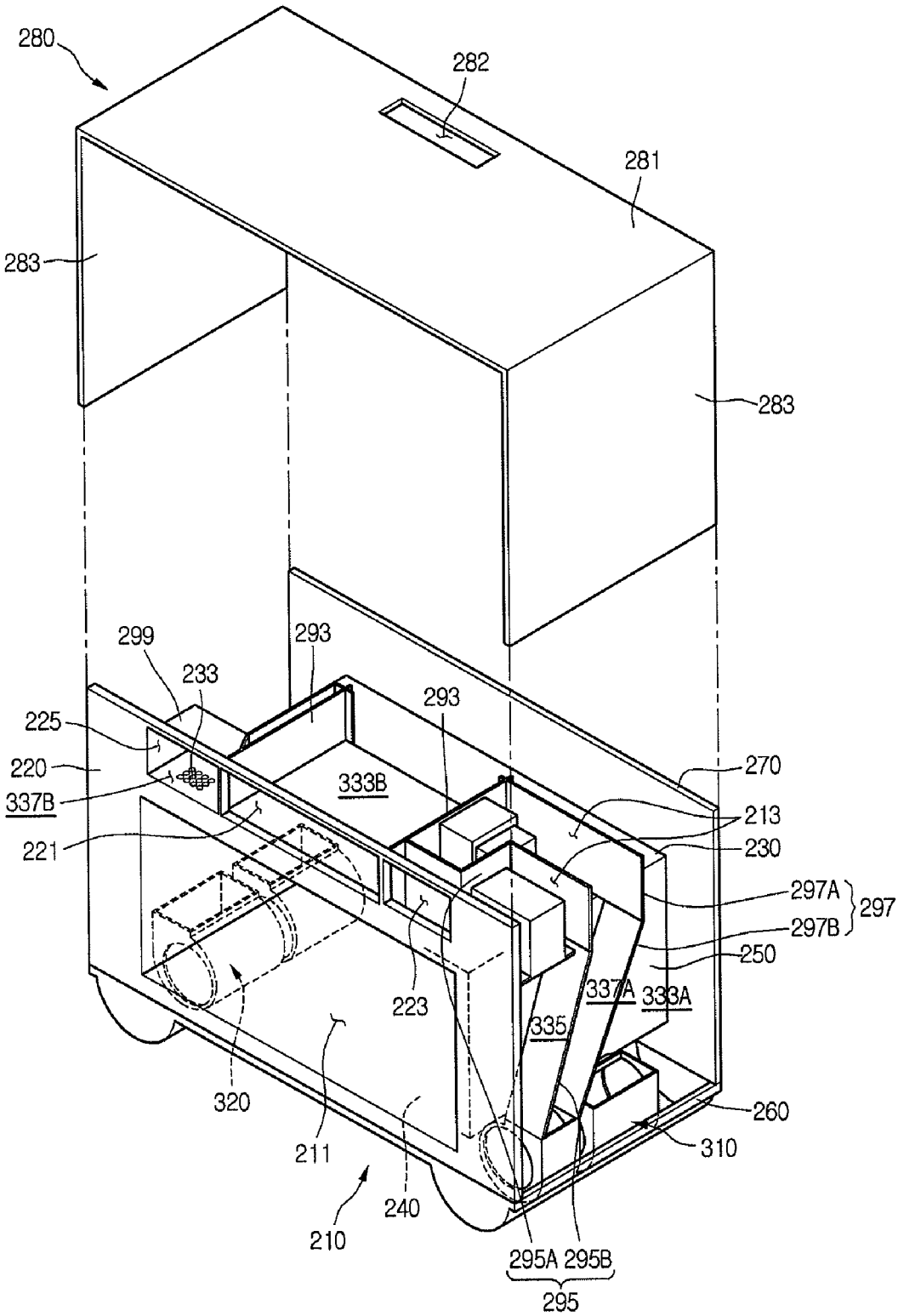
FIG. 2 is an exploded perspective view of the microwave range of the embodiment.
Figure 3:
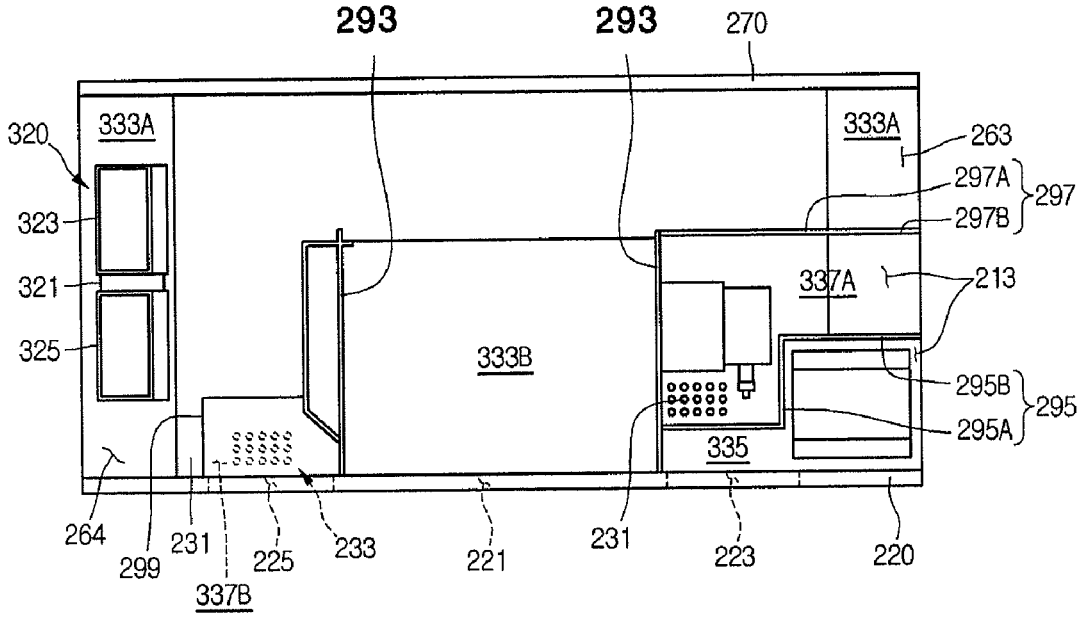
FIG. 3 is a plan view of the microwave range of the embodiment.
Figure 4:
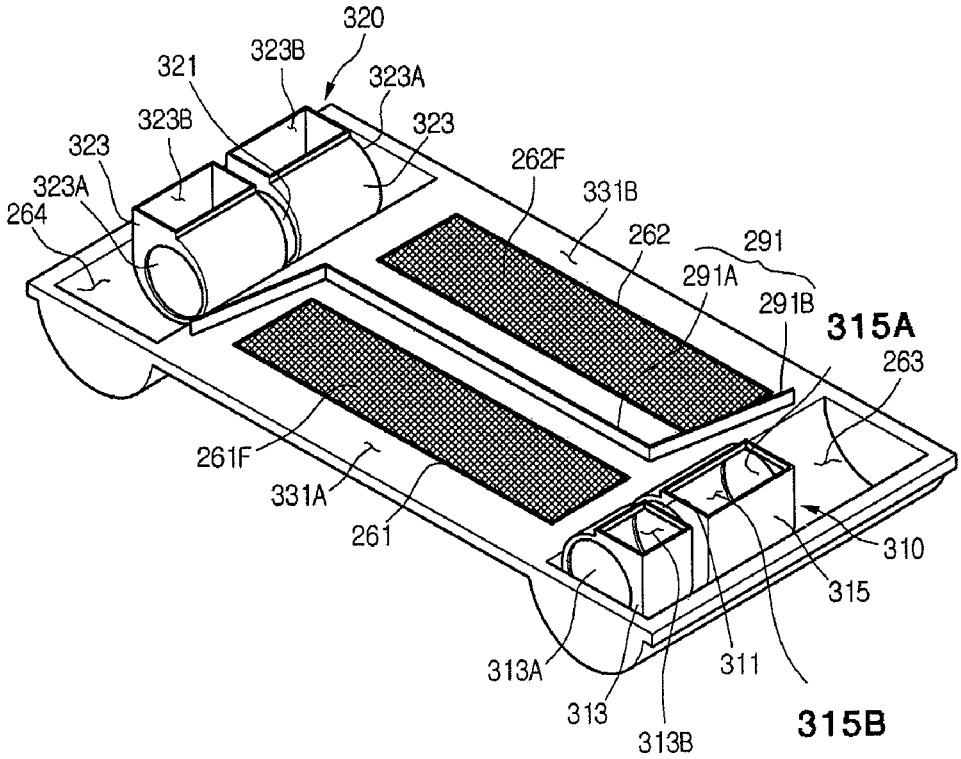
FIG. 4 is a perspective view of a portion of the microwave range of the embodiment.

FIG. 1 is a perspective view illustrating an embodiment of a microwave range 100 having a hood according to the present invention, FIG. 2 is an exploded perspective view illustrating the microwave of the embodiment, FIG. 3 is a plan view illustrating the microwave range of the embodiment, and FIG. 4 is a perspective view illustrating a portion of the microwave range of the embodiment.

Referring to FIGS. 1 to 4, a gas oven range 10 is installed in a kitchen. The gas oven range 10 includes a top burner unit 20, a grill unit 30, an oven unit 40, and a drawer unit 50. The top burner unit 20 performs a food cooking operation using combustion of a gas. Also, the grill unit 30, the oven unit 40, and the drawing unit 50 perform a food cooking operation using a heater. Although a gas oven range is shown in FIG. 1, the microwave range according to the present invention can be located above any suitable type of cooking appliance.

A microwave range 100 having a hood (referred to as a microwave range 100 hereinafter) is installed in the kitchen above the gas oven range 10. The microwave range 100 performs a cooking function of cooking food using microwaves, and a hood function of filtering contaminated air including an exhaust gas generated during a cooking operation of the gas oven range 10 and exhausting the filtered air to the outside. The microwave range 100 includes a main unit 200 and a door 400. Also, the main unit 200 is provided at its upper surface with an outdoor duct 500 for exhausting contaminated air to the outside.

Referring to FIGS. 2 and 3, a front plate 220 forms the front side of a chamber 210 constituting the main unit 200. Also, a top plate 230, a bottom plate 240, a pair of side plates 250, and a rear plate form the upper and lower sides, both side surfaces, and rear surface of the chamber 210, respectively.

The front plate 220 is provided at its upper end with an indoor air outlet 221 for a hood, an air inlet 223 for cooling, and an air outlet 225 for cooling. Referring to FIG. 2, the air inlet 223 for cooling and the air outlet 225 for cooling are provided in the right and left sides around the indoor air outlet 221 for the hood, respectively. The indoor air outlet 221 for the hood is designed for exhausting contaminated air to an indoor space. The air inlet 223 for cooling and the air outlet 225 for cooling are designed for introducing and exhausting air for cooling electric components which will be described below, respectively.

A vent grill 227 (refer to FIG. 1) is provided to the front upper end of the front plate 220 that corresponds to the indoor air outlet 221 for the hood, the air inlet 223 for cooling, and the air outlet 225 for cooling. The vent grill 227 shields the indoor air outlet 221 for the hood, the air inlet 223 for cooling, and the air outlet 225 for cooling, and allows air to be exhausted in a predetermined direction.

The top plate 230 is provided with a plurality of air introducing through holes 231 (refer to FIG. 3) and exhausting through holes 233. The air introducing through holes 231 and exhausting through holes 233 are designed for communication with a cooking room 211, an electric component room 213, and exhaust passages 337A and 337B for cooling. Referring to FIG. 3, the air introducing through holes 231 are formed in the right portion of the top plate 230, and the exhausting through holes 233 are formed in the left portion of the top plate 230.

The cooking room 211 is provided inside the chamber 210. The cooking room 211 is a portion where food is cooked. The cooking room 211 is selectively opened/closed using the door 400.

The top plate 230 is provided with the electric component room 213. In detail, the electric component room 213 is provided at one side of the top plate 230 that corresponds to the rear portion of the air inlet 223 for cooling. A variety of electric components for oscillating microwaves such as a magnetron, a high voltage capacitor, and a high voltage transformer are installed in the electric component room 213. In the present embodiment, the electric component room 213 is divided into a front portion and a rear portion by an air introducing guide 295 for cooling. The electric components are installed in the electric component room 213 in the front and rear portions.

A base plate 260 is installed at a lower portion of the chamber 210. The base plate 260 substantially forms a lower appearance of the main unit 200. The base plate 260 is installed at a lower portion of the chamber 210 such that the lower surface of the bottom plate 240 and the upper surface of the base plate 260 are vertically separated a predetermined distance from each other. Therefore, a predetermined space is formed between the bottom plate 240 and the base plate 260. An air introducing passage 331 for a hood is provided in the space.

Referring to FIG. 4, the base plate 260 is provided with a pair of air inlets 261 and 262 for a hood. The air inlets 261 and 262 for a hood are formed by cutting a portion of the base plate 260 in a predetermined shape. The air inlets may be of any suitable shape, such as a horizontally extending rectangular shape. The air inlets 261 and 262 for the hood serve as an entry through which contaminated air is introduced. In the present embodiment, the air inlets 261 and 262 for the hood are formed to be symmetric with respect to a virtual line equally dividing the base plate 260 into a front portion and a rear portion. In FIG. 4, the air inlet for the hood that is provided to the front of the base plate 260 is referred to as a first air inlet 261 for a hood, and the air inlet for the hood that is provided to the rear of the base plate 260 is referred to as a second air inlet 262 for a hood.

Each of the first and second air inlets 261 and 262 for the hood are provided with a filter 261F (262F). The filters 261F and 262F are designed for removing foreign substances contained in contaminated air introduced via the first and second air inlets 261 and 262 for the hood to filter the air.

The base plate 260 is provided at both ends thereof with fan installation portions 263 and 264. The fan installation portions 263 and 264 are formed as downwardly recessed portions in both sides of the base plate 260. The fan installation portions may be formed in any suitable shape, such as in a long rectangular shape extending in a back and forth direction. The fan installation portions may be formed in a substantially semi-cylindrical shape corresponding to the shapes of fan assemblies 310 and 320. In FIG. 4, the fan installation portion 263 on the right is referred to as a first fan installation portion 263, and the fan installation portion 264 on the left is referred to as a second fan installation portion 264.

Referring to FIG. 2 again, the chamber 210 is provided at its rear end with a back plate 270. The back plate 270 forms a rear appearance of the main unit 200. The front side of the back plate 270 is closely attached on the rear plate. That is, there is no space or passage formed between the rear plate and the back plate 270. An outer case 280 is installed at the upper portion and both sides of the chamber 210. The outer case 280 substantially includes an upper surface 281 forming the upper appearance of the main unit 200, and two lateral surfaces 283 forming both side appearances of the main unit 200. The upper surface 281 and both lateral surfaces 283 of the outer case 280 are separated vertically and horizontally by a predetermined distance from the top plate 230 and the side plates 250, respectively. An outdoor air outlet 282 for a hood is formed at the rear of the upper surface 281 of the outer case 280. The outdoor air outlet 282 for the hood is designed for exhausting contaminated air to the outside through the outdoor duct 500.

The top plate 230 and the base plate 260 are provided with a plurality of air guides. The air guides divide a passage provided between the bottom plate 240 and the base plate 260, and passages provided between the top plate 230, the upper surface and both lateral surfaces of the outer case 280 into air introducing passages 331A and 331B for a hood, exhaust passages 333A and 333B for a hood, an air introducing passage 335 for cooling, and exhaust passages 337A and 337B for cooling. Referring to FIGS. 3 and 4, the air guides include an air introducing guide 291 for a hood, an exhaust guide 293 for a hood, an air introducing guide 295 for cooling, and first and second exhaust guides 297 for cooling.

The air introducing guide 291 for the hood is provided on the upper surface of the base plate 260. The air introducing guide 291 for the hood divides contaminated air introduced via the first and second air inlets 261 and 262 for the hood to guide the air to vent fans 315 and 323 which will be described below.

The air introducing guide 291 for the hood includes a dividing rib 291A extending horizontally between the first and second air inlets 261 and 262 for the hood, and a pair of guide ribs 291B extending at a predetermined angle from both ends of the dividing rib 291A toward the front or rear. The dividing rib 291A and the guide ribs 291B are formed to have the same height as a distance between the bottom plate 240 and the base plate 260. Both ends of the dividing rib 291A are separated a predetermined distance from the fan installation portions 263 and 264. One guide rib 291B extends at a predetermined angle to the rear from the right end of the dividing rib 291A. Also, the other guide rib 291B extends at a predetermined angle to the front from the left end of the dividing rib 291A.

Referring to FIG. 3, the exhaust guide 293 for the hood is formed in a pair provided on the upper surface of the top plate 230. The exhaust guide 293 for the hood divides the exhaust passages 333A and 333B for the hood, the air introducing passage 335 for cooling, the exhaust passages 337A and 337B for cooling, and simultaneously guides contaminated air exhausted to the outside via the indoor air outlet 221 for the hood, or outdoor air outlet 282 for the hood. Also, the exhaust guide 293 for the hood substantially forms one side of the electric component room 213. The exhaust guide 293 for the hood extends along a back and forth direction on an upper surface of the top plate 230 corresponding to a space between the indoor air outlet 221 for the hood and the air inlet 223 for cooling, and a space between the indoor air outlet 221 for the hood and the air outlet 225 for cooling. At this point, the front end of the exhaust guide 293 is closely attached on a rear side of the front plate 220, and the rear end of the exhaust guide 293 is separated a predetermined distance from the rear side of the back plate 270.

Referring to FIG. 2 again, the air introducing guide 295 for cooling divides the air introducing passage 335 for cooling and the exhaust passages 337A and 337B for cooling, and guides air introduced through the air inlet 223 for cooling to the cooling fan 313 which will be described below.

The air introducing guide 295 for cooling includes an upper rib 295A and a side rib 295B. The upper rib 295A extends from the exhaust guide 293 that is shown in the right side of the drawing to the right on the upper surface of the top plate 230 that corresponds to the electric component room 213. The side rib 295B extends obliquely downward to the front from the right end of the upper rib 295A on the side plate 250. The upper rib 295A of the air introducing guide 295 for cooling substantially divides the electric component room 213 into a front portion and a rear portion. The upper rib 295A of the air introducing guide 295 for cooling can be provided with a height difference portion. The height difference portion of the upper rib 295A of the air introducing guide 295 for cooling is designed for more effective use of the electric component room 213 divided into the front and rear portions depending on the sizes or shapes of the electric components received in the electric component room 213. The air introducing guide 295 for cooling also guides air to more efficiently cool the electric components. The side rib 295B of the air introducing guide 295 for cooling has an upper end connected to the right end of the upper rib 295A of the air introducing guide 295 for cooling. Also, the side rib 295B of the air introducing guide 295 for cooling has a lower end connected between an air inlet 313A and a discharge portion 313B of the cooling fan 313.

The exhaust guide 297 for cooling divides the air introducing passage 335 for cooling and the exhaust passages 337A and 337B for cooling, and guides air to the electric component room 213. Like the air introducing guide 295 for cooling, the exhaust guide 297 for cooling also guides air in order to more efficiently cool the electric components. The exhaust guide 297 for cooling includes a side rib 297B and an upper rib 297A. The side rib 297B extends obliquely and upward to the rear on the side plate 250 on the right in the drawing. The upper rib 297A extends from the upper end of the side rib 297B to the left on the top plate 230. The lower end of the side rib 297B of the exhaust guide 297 for cooling is connected to one side of the cooling fan 313 such that the discharge portion 313B of the cooling fan 313 is located between the air introducing guide 295 for cooling and the exhaust guide 297 for cooling. The upper rib 297A of the exhaust guide 297 for cooling substantially forms a rear side of the electric component room 213. The right end of the upper rib 297A of the exhaust guide 297 for cooling is connected to the upper end of the side rib 297B of the exhaust guide 297 for cooling. Also, the left end of the upper rib 297A of the exhaust guide 297 for cooling is connected to the rear end of an exhaust guide on the right of the exhaust guides 293 for the hood.

The top plate 230 is provided at its one side with an exhaust duct 299 for cooling. The exhaust duct 299 for cooling is provided to the left side of the exhaust guide on the left of the exhaust guides 293 for the hood in FIG. 2. The exhaust duct 299 for cooling divides the exhaust passages 333A and 333B for the hood and the exhaust passage 337B for cooling. The exhaust duct 299 for cooling is provided to the top plate 230 such that the exhaust through holes 233 are located inside the exhaust duct 299 for cooling. Also, the front end of the exhaust duct 299 for cooling is closely attached on the rear side of the front plate 220. The lower end and one end of the exhaust duct 299 for cooling are closely attached on the upper surface of the top plate 230, and the left side of the exhaust guide on the left of the exhaust guides 293 for the hood.

The first and second fan installation portions 263 and 264 are provided with the fan assemblies 310 and 320, respectively. That is, the first fan installation portion 263 is provided with a first fan assembly 310, and the second fan installation portion 264 is provided with a second fan assembly 320. The first and second fan assemblies 310 and 320 are designed for a hood function and providing driving force for cooling the electric components. In other words, the first and second fan assemblies 310 and 320 provide driving force for introducing contaminated air via the first and second air inlets 261 and 262 for the hood and exhausting the air via the indoor air outlet 221 for the hood, and driving force for introducing air via the air inlet 223 for cooling to cool the electric components, and exhausting the air via the air outlet 225 for cooling.

Each of the first and second fan assemblies 310 and 320 includes one fan motor 311(321) and a pair of fans. Here, a fan 313 at the front end (referred to as a cooling fan) of fans of the first fan assembly 310 is designed for cooling the electric components. Also, a fan 315 at the rear end (referred to as a first vent fan) of the fans of the first fan assembly 310, and fans 323 and 325 (referred to as second vent fans) of the second fan assembly 320 are designed for a hood function.

The cooling fan 313 is provided with the air inlet 313A and the discharge portion 313B. The air inlet 313A of the cooling fan 313 communicates with the air introducing passage 335 for cooling. The air inlet 313A of the cooling fan 313 is separated a predetermined distance from the front end of the first fan installation portion 263. Also, the discharge portion 313B of the cooling fan 313 communicates with the first exhaust passage 337A for cooling.

The first vent fan 315 is provided with an air inlet 315A and a discharge portion 315B. The air inlet 315A of the first vent fan 315 communicates with the first air introducing passage 331A for the hood. Also, the air inlet 315A of the first vent fan 315 is separated a predetermined distance from the rear end of the first fan installation portion 263. At this point, the distance between the air inlet 315A of the first vent fan 315 and the rear end of the first fan installation portion 263 is determined within a range allowing contaminated air to be introduced to the air inlet 315A of the first vent fan 315. The discharge portion 315B of the first vent fan 315 communicates with the exhaust passages 333A and 333B of the hood.

Each of the second vent fans 323 is provided with an air inlet 323A and a discharge portion 323B. The air inlets 323A of the second vent fans 323 communicate with a second air introducing passage 331B for a hood. Also, the air inlet 323A of the second vent fan 323 is separated a predetermined distance from the front or rear end of the second fan installation portion 264. At this point, the distance between the air inlet 323A of the second vent fan 323 and the front or rear end of the second fan installation portion 264 is determined within a range allowing contaminated air to be introduced to the air inlet 323A of the second vent fan 323. The discharge portion 323B of the second vent fan 323 communicates with the exhaust passages 333A and 333B of the hood.

Meanwhile, the chamber 210 is provided with a plurality of passages, i.e., the air introducing passages 331A and 331B for the hood, the exhaust passages 333A and 333B for the hood, the air introducing passage 335 for cooling, and the exhaust passages 337A and 337B for cooling. The air introducing passages 331A and 331B for the hood and the exhaust passages 333A and 333B for the hood are portions through which contaminated air flows. The air introducing passage 335 for cooling and the exhaust passages 337A and 337B for cooling are portions through which air for cooling the electric components flows.

Referring to FIG. 4, the air introducing passages 331A and 331B for the hood is a portion through which contaminated air introduced via the first and second air inlets 261 and 262 for the hood and delivered to the air inlets 315A and 323A of the first and second vent fans 315 and 323 flows. The air introducing passages 331A and 331B of the hood is provided between the bottom plate 240 and the base plate 260.

Also, the air introducing passages 331A and 331B for the hood are divided by the air introducing guide 291 for the hood into a first air introducing passage 331A for a hood and a second air introducing passage 331B for a hood. The first and second air introducing passages 331A and 331B for the hood are provided between the bottom plate 240 and the base plate 260 to include the first and second air inlets 261 and 262 for the hood, respectively. Also, the first and second air introducing passages 331A and 331B for the hood communicate with the air inlet 315A of the first vent fan 315 and the air inlets 323A of the second vent fans 323, respectively. That is, contaminated air introduced via the first air inlet 261 for the hood flows through the first air introducing passage 331A for the hood and is introduced to the air inlet 315A of the first vent fan 315. Also, contaminated air introduced via the second air inlet 262 for the hood flows through the second air introducing passage 331B for the hood and is introduced to the air inlets 323A of the second vent fans 323.

Referring to FIGS. 2 and 3, the exhaust passages 333A and 333B for the hood are portions through which contaminated air discharged from the discharge portions 315B and 323B of the first and second vent fans 315 and 323 and exhausted to the outside flows. The exhaust passages 333A and 333B for the hood include a first exhaust passage 333A for a hood and a second exhaust passage 333B for a hood.

The first exhaust passage 333A for the hood is a portion through which contaminated air discharged from the discharge portions 315B and 323B of the first and second vent fans 315 and 323 flows upward. The lower end of the first exhaust passage 333A for the hood communicates with the discharge portions 315B and 323B of the first and second vent fans 315 and 323. The first exhaust passage 333A for the hood is provided between the side plate 250 and the inner surfaces of both sides 283 of the outer case 280. Referring to FIG. 2, the first exhaust passage provided to the right of the chamber 210, of the first exhaust passages 333A for the hood is provided in a space that excludes the air introducing passage 335 for cooling and the exhaust passage 337A for cooling, of spaces formed between the side plate 250 and one of the sides 283 of the outer case 280.

The second exhaust passage 333B for the hood is a portion through which contaminated air that has flowed upward via the first passage 333A for the hood flows horizontally so that it may be exhausted to the outside. Both ends of the second exhaust passage 333B for the hood communicate with the upper end of the first exhaust passage 333A for the hood. Also, the front end of the second exhaust passage 333B for the hood communicates with the indoor air outlet 221, and one side at the upper end of the second exhaust passage 333B for the hood communicates with the outdoor air outlet 282 for the hood. The second exhaust passage 333B for the hood is provided between the top plate 230 and the upper surface 281 of the outer case 280. The second exhaust passage 333B for the hood is provided in a space that excludes the electric component room 213, the air introducing passage 335 for cooling, and the exhaust passages 337A and 337B for cooling, and that is formed between the top plate 230 and the upper surface 281 of the outer case 280.

The air introducing passage 335 for cooling is provided on one side of the front end of the chamber 210. The air introducing passage 335 for cooling is provided in a space surrounded by the front plate 220, the top plate 230, the upper surface 281 and one side 283 of the outer case 280, and the air introducing guide 295 for cooling. The air introducing passage 335 for cooling is a portion through which air introduced via the air inlet 223 for cooling to the air inlet 313A of the cooling fan 313 flows. Also, as described above, some of the electric components are installed in the front portion of the electric component room 213 divided by the air introducing guide 295 for cooling, and the rest of the electric components are installed in the rear portion of the electric component room 213. Therefore, some of the electric components are cooled by air that flows through the air introducing passage 335 for cooling and is introduced to the air inlet 313A of the cooling fan 313.

The exhaust passages 337A and 337B for cooling are portions through which air exhausted by the discharge portion 313B of the cooling fan 313 and exhausted to an indoor space via the air outlet 225 for cooling flows. The exhaust passages 337A and 337B for cooling includes a first exhaust passage 337A for cooling and a second exhaust passage 337B for cooling.

The first exhaust passage 337A for cooling is provided in a space surrounded by the top plate 230 rearward of the introducing passage 335 for cooling, the upper surface 281 and one side 283 of the outer case 280, the air introducing guide 295 for cooling, and the exhaust guide 297 for cooling. The lower end of the first exhaust passage 337A for cooling communicates with the discharge portion 313B of the cooling fan 313. Also, the air inlet through holes 231 are formed inside the first exhaust passage 337A for cooling, more specifically, in one side of the top plate 230 corresponding to the bottom of the electric component room 213 that is located in the first exhaust passage 337A for cooling.

The second exhaust passage 337B for cooling is a portion through which air having flowed through the first exhaust passage 337A for cooling, and having been delivered to the cooking room 211 through the air introducing through holes 231, and having circulated through the cooking room 211 flows. The second exhaust passage 337B for cooling is a portion through which air having circulated through the cooking room 211 and being exhausted to an indoor space via the air outlet 225 for cooling flows. For this purpose, the air exhaust through holes 233 are substantially formed in one side of the top plate 230 corresponding to the second exhaust passage 337B for cooling. The second exhaust passage 337B for cooling is provided inside the exhaust duct 299 for cooling, that is, between the top plate 230 and the exhaust duct 299 for cooling.

An operation of a microwave range having a hood will be described below according to an embodiment of the present disclosure.

First, a process of circulating contaminated air will be described below according to the microwave range 100 having the hood in an embodiment of the present disclosure.

When a user operates the microwave range, the first and second vent fans 315 and 323 constituting the fan assemblies 310 and 320 are driven. When the first and second vent fans 315 and 323 are driven, contaminated air including an exhaust gas generated during a cooking operation of a gas oven range 10 is introduced via the first and second air inlets 261 and 262 for the hood to flow through the first and second air introducing passages 331A and 331B for the hood. While the contaminated air is introduced via the first and second air inlets 261 and 262 for the hood, various foreign substances contained in the contaminated air are filtered by the filters 261F and 262F.

Meanwhile, the air flowing through the first and second air introducing passages 331A and 331B for the hood is guided by the air introducing guide 291 for the hood and introduced to the air inlets 315A and 323A of the first and second vent fans 315 and 323. Also, air that has been introduced to the air inlets 315A and 323A of the first and second vent fans 315 and 323 is exhausted by the discharge portions 315B and 323B of the first and second vent fans 315 and 320.

Air that has been exhausted by the discharge portions 315B and 323B of the first and second vent fans 315 and 323 flows through the first and second exhaust passages 333A and 333B for the hood, and is exhausted to an indoor space via the indoor air outlet 221 for the hood and the vent grill 227. Of course, air that is exhausted by the discharge portions 315B and 323B of the first and second vent fans 315 and 323 can be exhausted to the outside via the outdoor air outlet 282 for the hood and the outdoor duct 500.

Next, a process of circulating air for cooling the electric components will be described according to an embodiment of the present disclosure.

As described above, when a microwave range operates, the cooling fans 313 constituting part of the fan assembly 310 is driven. Air introduced via the air inlet 223 for cooling by the driving of the cooling fan 313 flows through the air introducing passage 335 for cooling and is introduced to the air inlet 313A of the cooling fan 313. At this point, some of the electric components installed in the air introducing passage 335 for cooling are cooled by the flowing air.

Also, the air that has flowed through the air introducing passage 335 for cooling and been introduced to the air inlet 313A of the cooling fan 313 is exhausted by the discharge portion 313B of the cooling fan 313. The air exhausted by the discharge portion 313B of the cooling fan 313 flows through the first exhaust passage 337A for cooling. At this point, some of the electric components that are installed in the first exhaust passage 337A for cooling are cooled by the flowing air.

Meanwhile, air that has cooled the electric components while flowing through the first exhaust passage 337A for cooling is delivered to the cooking room 211 via the air introducing through holes 231. Also, air that has been delivered to the cooking room 211 circulates through the cooking room 211. A variety of foreign substances generated in the inside of the cooking room 211 during a cooking process is included in air while the air circulates through the cooking room 211.

The air that has circulated through the cooking room 211 is delivered to the second exhaust passage 337B for cooling via the exhaust through holes 233. The air that has been delivered to the second exhaust passage 337B for cooling is exhausted to an indoor space through the air outlet 225 for cooking and vent grill 227.

As described above, a microwave range having a hood according to an embodiment of the present disclosure provides the following effects.

First, a pair of fan assemblies is provided for a hood function. Therefore, even when a large amount of exhaust gases are generated from the cooking appliance, the exhaust gases can be sufficiently exhausted to an indoor or outdoor space by the fan assemblies.

Also, according to the present disclosure, the fan assembly is installed in the fan installation portion formed by recessing a portion of the base plate downward. Therefore, the cooking room can be designed to have a maximum volume regardless of the size of the fan assembly.

Also, the electric components can be cooled by fans constituting part of the fan assembly. Therefore, the output of the fan assembly can be efficiently distributed for a hood exhaust function and cooling of the electric components.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A microwave range having a hood for removing contaminated air, the microwave range comprising:

a chamber;

a cooking room, provided inside the chamber, in which food is to be cooked;

at least one electric component configured to oscillate microwaves to cook the food; and first and second vent fan assemblies respectively positioned at opposite lateral sides of the chamber, the first and second vent fan assemblies to draw contaminated air in through an air inlet located on a bottom surface of the microwave range below the chamber, and to exhaust the air drawn in through the air inlet, wherein each of the first and second vent fan assemblies comprises a fan motor and a pair of fans respectively driven by the fan motor, and wherein at least one of the vent fan assemblies includes a cooling fan to cool the electric components, and a vent fan to draw in and exhaust the contaminated air.

2. The microwave range according to claim 1, wherein the contaminated air drawn in through the air inlet is distributed to and flows through the first and second vent fan assemblies.

3. The microwave range according to claim 1, further comprising an air introduction guide configured to guide the contaminated air drawn in through the air inlet so that it is distributed to and flows through the first and second vent fan assemblies.

4. The microwave range according to claim 1, wherein the air inlet comprises first and second air inlets, the microwave range further comprising an air introduction guide configured to guide the contaminated air drawn in through the first and second air inlets so that it is distributed to and flows through first and second vent fan assemblies.

5. The microwave range according to claim 1, wherein the first and second vent fan assemblies are respectively positioned on left and right sides of an upper surface of a base plate in which the air inlet is provided.

6. The microwave range according to claim 1, wherein the first and second vent fan assemblies are respectively installed on fan installation portions formed on left and right sides of an upper surface of a base plate in which the air inlet is provided.

7. The microwave range according to claim 6, wherein the fan installation portions are formed as downwardly recessed portions of the base plate configured to receive a vent fan assembly.

8. The microwave range according to claim 1, wherein each of the first and second vent fan assemblies comprises a vent motor and a pair of vent fans respectively located on opposite sides of the vent motor.

9. A microwave range having a hood for removing contaminated air, the microwave range comprising:

a chamber;

a cooking room, provided inside the chamber, in which food is to be cooked;

at least one electric component configured to oscillate microwaves to cook the food; and first and second fan assemblies that draw contaminated air in through an air inlet located on a bottom surface of the microwave range below the chamber, exhaust the air drawn in through the air inlet, and flow air through the electric component room to cool the electric components, wherein each of the first and second fan assemblies comprises a fan motor and a pair of fans respectively driven by the fan motor, and wherein at least one of the fan assemblies includes a cooling fan to cool the electric components, and a vent fan to draw in and exhaust the contaminated air.

10. The microwave range according to claim 9, further comprising an air introduction guide configured to guide the contaminated air drawn in through the air inlet such that the contaminated air drawn in through the air inlet flows only to the vent fan.

11. The microwave range according to claim 9, further comprising:

an air introduction guide for cooling that guides air drawn in through an air inlet for cooling formed in a front side of the chamber to flow through an air inlet of the cooling fan; and an exhaust guide for cooling that guides air exhausted by a discharge portion of the cooling fan to the electric component room.

12. The microwave range according to claim 11, wherein the air introduction guide for cooling separates the electric component room into at least two spaces containing the electric components.

13. A microwave range having a hood for removing contaminated air, the microwave range comprising:

a cooking room, provided inside a chamber, in which food is to be cooked;

at least one electric component configured to oscillates microwaves to cook the food;

an air introduction passage for venting, through which contaminated air drawn in by a vent fan flows, the vent fan being part of at least one of a pair of fan assemblies;

an exhaust passage for venting, through which contaminated air is exhausted to an outside by the vent fan;

an air introduction passage for cooling, through which air drawn in by a cooling fan flows to cool electric components contained in an electric component room by driving of a cooling fan, the cooling fan being part of at least one of the pair of fan assemblies; and an exhaust passage for cooling, through which air that has cooled the electric components is exhausted to an outside by the cooling fan, wherein the vent fan and cooling fan are driven by a fan motor.

14. The microwave range according to claim 13, wherein the air introduction passage for venting is provided between a chamber and a base plate located below the chamber, and contaminated air drawn in through an air inlet for venting formed in the base plate flows through the air introduction passage for venting, and is introduced to an air inlet of the vent fan, the vent fan being installed in one of two fan installation portions provided on left and right sides of an upper surface of the base plate.

15. The microwave range according to claim 13, wherein the exhaust passage for venting comprises:

a first exhaust passage for venting provided on both sides of a chamber; and a second exhaust passage for venting provided on an upper surface of the chamber, and having lateral ends that communicate with upper ends of the first exhaust passage for venting, wherein contaminated air exhausted by a discharge portion of the vent fan installed in one of two fan installation portions provided on left and right sides of an upper surface of a base plate located below the chamber flows through the first and second exhaust passages for venting and is exhausted through one of an indoor air outlet formed in a front side of the chamber, and an outdoor air outlet formed in an upper side of an outer case of the chamber.

16. The microwave range according to claim 13, wherein the electric component room is separated into two spaces which are respectively located on the air introduction passage for cooling and the exhaust passage for cooling, and the electric components are contained in both spaces of the electric component room.

17. The microwave range according to claim 13, wherein the air introduction passage for cooling and the exhaust passage for cooling are separated from each other by an air guide for cooling, and air drawn in through an air inlet for cooling formed in a front side of a chamber flows through the air introduction passage for cooling, enters an air inlet of the cooling fan, and is exhausted by a discharge portion of the cooling fan to flow through the exhaust passage for cooling.

18. The microwave range according to claim 13, wherein the electric component room is separated into two spaces by an air guide for cooling that serves as a partition between the air introduction passage for cooling and the exhaust passage for cooling, and the electric components are installed in each of the two spaces of the electric component room.

19. The microwave range according to claim 13, wherein the exhaust passage for cooling comprises:

a first exhaust passage for cooling, through which air exhausted by a discharge portion of the cooling fan and delivered to the electric component room flows; and a second exhaust passage for cooling, through which air is exhausted to an outside through an air outlet for cooling formed in a front side of a chamber, after the air has cooled the electric components in the electric component room, and has been circulated through a cooking room provided inside the chamber.

* * * * *